United States Patent [19]

Hornack et al.

[11] Patent Number: 4,705,106

[45] Date of Patent: Nov. 10, 1987

[54] WIRE BRUSH HEAT EXCHANGE INSERT AND METHOD

[75] Inventors: Thomas R. Hornack, Lower Burrell; Melvin H. Brown, Allegheny Township, Armstrong County, both of Pa.

[73] Assignee: Aluminum Company of America, Pittsburgh, Pa.

[21] Appl. No.: 879,619

[22] Filed: Jun. 27, 1986

[51] Int. Cl.[4] ..... F28F 1/40

[52] U.S. Cl. ..... 165/179; 122/155 A; 165/904

[58] Field of Search ..... 165/904, 179; 110/322, 110/323; 122/155 A, 44 A

[56] References Cited

U.S. PATENT DOCUMENTS

| | | | |
|---|---|---|---|
| 2,079,144 | 5/1937 | Appa | 257/262 |
| 2,247,199 | 6/1941 | Kritzer | 29/157.3 |
| 2,254,587 | 9/1941 | Williams | 62/1 |
| 2,310,970 | 2/1943 | Limpert | 257/262 |
| 2,453,448 | 11/1948 | McTurk | 257/262.20 |
| 2,553,142 | 5/1951 | McCreary | 29/157.3 |
| 2,608,968 | 9/1952 | Moseley | 165/904 X |
| 3,195,627 | 7/1965 | Goodloe | 165/181 |
| 3,220,647 | 11/1965 | Riordan et al. | 165/904 X |
| 3,468,345 | 9/1969 | Tam et al. | 138/38 |
| 3,554,893 | 1/1971 | DeVarda | 204/244 |
| 3,636,982 | 1/1972 | Drake | 138/38 |
| 3,755,099 | 8/1973 | Haupin | 204/64 R |
| 3,783,938 | 1/1974 | Chartet | 165/166 |
| 3,784,371 | 1/1974 | Bangs et al. | 75/68 R |
| 3,785,941 | 1/1974 | Jacobs | 204/67 |
| 3,800,182 | 3/1974 | Wilczek | 315/3.5 |
| 3,825,063 | 7/1974 | Cowans | 165/146 |
| 3,825,064 | 7/1974 | Inoue | 165/179 |
| 3,847,212 | 11/1974 | Withers et al. | 165/179 |
| 3,859,040 | 1/1975 | Shefsiek et al. | 432/214 |
| 3,870,081 | 3/1975 | Kleppe et al. | 138/38 |
| 3,884,792 | 5/1975 | McGilvery | 204/290 F |
| 3,886,976 | 6/1975 | Kardas et al. | 138/38 |
| 3,895,675 | 7/1975 | Rein et al. | 165/164 |
| 3,996,117 | 12/1976 | Graham et al. | 204/67 |
| 4,049,511 | 9/1977 | Alder et al. | 204/67 |
| 4,090,559 | 5/1978 | Megerlin | 165/179 |
| 4,098,651 | 7/1978 | Alder | 204/1 T |
| 4,110,178 | 8/1978 | LaCamera et al. | 204/64 R |
| 4,113,009 | 9/1978 | Meyer et al. | 165/154 |
| 4,116,270 | 9/1978 | Marushkin et al. | 165/162 |
| 4,119,519 | 10/1978 | Clapper | 204/268 |
| 4,121,983 | 10/1978 | Kinosz et al. | 204/67 |
| 4,147,210 | 4/1979 | Pronko et al. | 165/165 |
| 4,170,533 | 10/1979 | Alder et al. | 204/243 R |
| 4,197,169 | 4/1980 | Zahn et al. | 204/1 R |
| 4,197,178 | 4/1980 | Pellegri et al. | 204/255 |
| 4,243,502 | 1/1981 | Kugler | 204/243 R |
| 4,257,855 | 3/1981 | Zaromb | 204/67 |
| 4,265,275 | 5/1981 | Heller et al. | 138/38 |
| 4,279,731 | 7/1981 | Pellegri | 204/254 |
| 4,288,309 | 9/1981 | Cohen | 204/225 |
| 4,296,779 | 10/1981 | Smick | 138/38 |
| 4,306,619 | 12/1981 | Trojani | 165/179 |
| 4,341,262 | 7/1982 | Alspaugh | 165/1 |
| 4,351,392 | 9/1982 | Stockman | 165/904 X |
| 4,352,378 | 10/1982 | Bergmann et al. | 138/38 |
| 4,559,998 | 12/1985 | Counterman | 165/904 X |

FOREIGN PATENT DOCUMENTS

| | | | |
|---|---|---|---|
| 619224 | 5/1961 | Canada | 165/DIG. 6 |
| 382436 | 10/1923 | Fed. Rep. of Germany | 122/155 A |
| 86913 | 10/1920 | Switzerland | 165/DIG. 6 |
| 1462332 | 1/1977 | United Kingdom . | |

OTHER PUBLICATIONS

*Machine Design*, Feb. 25, 1982, p. 44.

*Primary Examiner*—Albert W. Davis, Jr.
*Assistant Examiner*—Randolph A. Smith
*Attorney, Agent, or Firm*—Douglas G. Glantz

[57] ABSTRACT

The present invention provides heat exchanger apparatus and method including a tubular heat transfer surface, a heat transfer fluid which is made to pass along the surface, and a wire brush heat exchanger insert positioned to impinge the fluid flowing within the heat transfer surface. The brush heat exchange insert is composed of a ceramic material having a high absorptance and emittance.

20 Claims, 4 Drawing Figures

WIRE BRUSH HEAT EXCHANGE INSERT AND METHOD

BACKGROUND OF THE INVENTION

This invention relates to an apparatus and method for enhancing heat transfer in a heat exchanger.

Heat exchangers typically involve a fluid flowing in a conduit and the exchange of heat between the fluid and the conduit. For example, chemical process plants typically use shell and tube-type heat exchangers to provide heat exchange between a fluid and a conduit.

In the design of heat exchangers, it is well known that heat transfer between a fluid flowing along a heat exchanger surface or conduit is confined primarily to a layer of fluid in contact with the heat exchanger surface. Previous attempts to enhance heat transfer include fin structures extending from the heat exchanger surface and contacting the fluid to set up a flow disturbance which prevents the stratifying or laminar flow of the fluid flowing against the heat exchanger surface. The fins typically are formed to contact the heat exchanger surface and provide higher conductive heat transfer from the fluid to the surface.

An insert device known as a turbulator has been employed in heat exchangers to provide a turbulent flow of the fluid against the inside surface of the conduit or tube in which the fluid is flowing. The turbulator in the tube improves heat transfer primarily by slowing down the velocity of the fluid flowing through the central portion of the tube or pipe cross section, and further improves the temperature distribution of the fluid in the cross section of the tube or conduit by conduction and mixing.

It is known that heat transfer applications at high temperatures involve a radiation of heat transfer which takes on a dominant influence over convection and conductive heat transfer. Attempts have been made to take advantage of higher radiation heat transfer by providing reradiant inserts. An example of a reradiant insert would be a gas recuperator as is disclosed in Kardas et al U.S. Pat. No. 3,886,976. The Kardas insert uses a floating extended surface which provides an additional area for accepting heat by convection and radiation from the hot gas in the recuperator, the Kardas insert not being integrally connected with the original heat receiving surface. Heat is retransmitted to the intended heat transfer surface by a continuous spectrum of Stefan-Boltzmann radiation. The Kardas et al patent discloses that radial mixing and large effecting radiating area can be obtained by using multileaf reradiators of the type shown in the Kardas patent in FIG. 5.

However, the aforementioned fins, turbulators, and recuperators have a major drawback in that these devices require a significant pressure drop through the conduit. Further, the aforementioned turbulators and fins are designed for lower temperature operation and do not produce the most efficient heat exchange insert at higher temperatures.

It is an object of the present invention to provide heat exchanger apparatus and method for enhancing heat exchange between a fluid and a heat exchanger surface such as a heat exchanger tube or conduit.

It is another object of the present invention to provide heat exchanger apparatus and method of enhanced efficiency at higher temperature differences between the fluid and heat exchanger surface.

It is yet another object of the present invention to provide heat exchanger apparatus and method of enhanced efficiency requiring a minimum pressure drop through the heat exchanger.

SUMMARY OF THE INVENTION

In accordance with the present invention, heat exchanger apparatus and method are provided for enhancing the heat transfer between a fluid and tubular heat exchanger surface. The heat exchange apparatus of the present invention includes a tubular heat transfer surface, means for passing a heat transfer fluid along the surface, and a brush heat exchange insert positioned to impinge the fluid flowing within the heat transfer surface. In one aspect, the brush heat exchange insert is composed of a ceramic material having a high absorptance and emittance.

The method of the present invention includes establishing the heat transfer insert of the present invention of a wire brush insert positioned in a tube or channel to impinge the flow of a heat exchanger fluid on the surface of the insert and to enhance the heat exchange between the fluid and the heat exchange surface.

DETAILED DESCRIPTION OF THE INVENTION

Figure 1A:
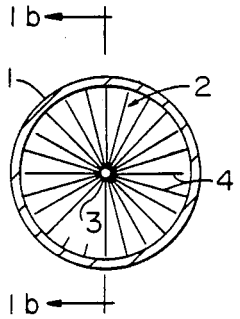
FIG. 1*a* and FIG. 1*b* depict cross-sectional views of heat exchanger tubes including an insert according to the present invention.

Referring to FIG. 1*a*, an elevational view of a cross section of pipe 1 is depicted. Heat exchange insert 2 is provided in pipe 1. Heat exchange insert 2 as depicted in FIG. 1*a* can be viewed as the longitudinal end view of a wire brush having core 3 and appendages 4. All of the appendages 4 are not required to contact the inside wall of the heat exchanger surface inside wall 6 of the tube or conduit 1 as will be explained hereinafter.

Figure 1B:
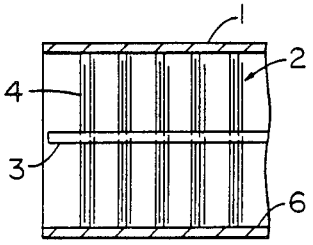

Referring to FIG. 1*b*, pipe 1 is shown in a cross-sectional side view.

The heat exchange inserts of the present invention as depicted as insert 2 in FIG. 1*a* and FIG. 1*b* have the shape substantially similar to a wire brush.

We have found that the number of bristles on the brush should be at least 50 per linear of brush. An insert having less than 50 bristles per linear inch provides a less efficient operation in heat transfer efficiency. On the other hand, the bristles should not be more than 500 bristles per linear inch or a pressure drop required to operate the heat exchange apparatus will be excessive.

The heat exchange insert of the present invention improves flow through a heat exchanger conduit and reduces pressure drop over prior art inserts such as turbulators.

It has been found unexpectedly that the wires of the present invention transfer more heat from a gas to a heat exchanger surface than is transferred with heat exchange inserts such as panels. An attempt at explaining why this occurs is as follows.

Heat transfer involves three fundamental mechanisms: conduction, convection, and radiation. Conduction involves heat transfer from one location of a unit mass to another location of the same unit mass or from a first unit mass to a second unit mass in physical contact with the first without significant movement of the particles of the unit's mass. Convection involves heat transfer from one location to another location within a fluid, either gas or liquid, by mixing within the fluid. Natural convection involves motion of the fluid from density differences attributable to temperature differences. Forced convection involves motion in the fluid set up by mechanical work applied to the fluid. At low forced velocities in the fluid, density and temperature differences are more important than at higher forced velocities. Radiation involves the heat transfer from one unit mass to another unit mass not contacting the first. Radiation takes place through a wave motion through space.

Heat transfer by conduction can be described by a fundamental differential equation known as Fourier's Law:

$$\frac{dQ}{d\theta} = -kA\frac{dt}{dx} \tag{1}$$

wherein $dQ/d\theta$ (quantity per unit time) is heat flow rate; A is area at right angles to the direction of heat flow; and $-dt/dx$ is temperature change rate with respect to distance in the direction of heat flow, i.e., temperature gradient. The thermal conductivity is defined by k, which is dependent on the material through which the heat flows and further is dependent on temperature. Convective heat transfer involves a coefficient of heat transfer which is dependent on characteristics of fluid flow. Turbulent flow of a fluid past a solid sets up a relatively quiet zone of fluid, commonly called a film in the immediate vicinity of the surface. Approaching the wall from the flowing fluid, the flow becomes less turbulent and can be described as laminar flow near the surface. The aforementioned film is that portion of the fluid in the laminar motion zone or layer. Heat is transferred through the film by molecular conduction. In this latter aspect, light gases have the most resistance to heat transfer through the film and liquid metals have the least resistance through the laminar film region. The equation for describing heat transfer from the flowing fluid to the surface is set forth as follows in equation (2):

$$Q = hA\Delta T \tag{2}$$

wherein

Q = Quantity of heat transferred per unit time Btu/hr.

h = Coefficient of heat transfer = quantity of heat Btu/(hrft$^2$° F.) transferred per unit area and unit time per unit of temperature difference across the film.

A = Area-ft$^2$

T = Temperature difference between the gas and surface -° F.

Thermal radiation heat transfer involves an electromagnetic transport of energy from an emitting source excited by temperature. The energy is absorbed in another matter at distances from the emitting source in amounts dependent on the mean free path of the electromagnetic energy being transported. Radiation is different from conduction and convection mathematically based not only on this mean free path but also on a much more significant influence by temperature differences. In general, thermal radiation heat transfer can be described by the following equation:

$$Q = 0.172\,A\left[\left(\frac{T_1}{100}\right)^4 - \left(\frac{T_2}{100}\right)^4\right](F_A)(F_E) \tag{3}$$

wherein

Q = Net rate of heat radiation Btu/hr.

A = Area of one of the two surfaces - ft$^2$.

$T_1$ = Temperature of hottest surface -° R.

$T_2$ = Temperature of coolest surface -° R.

$F_A$ = Factor related to angle throughout which one surface sees the other.

$F_E$ = Emissivity factor.

A significant problem with heat transfer from gases to a surface is a high convective heat transfer resistance attributable to gas films. The present invention overcomes this problem and provides a much higher radiative heat transfer rate by gases flowing to impinge a heat exchange insert as contrasted to gases otherwise flowing inside pipes.

When high temperatures are involved, much more heat can be transferred by radiation than by convection. In accordance with the present invention, heat transfer rates for gases flowing inside pipes or channels are increased significantly by combining radiative heat transfer with convective and conductive effects. Wire brush heat exchange inserts are positioned to impinge the flow of gas in the pipe. Further, these wire brush heat exchange inserts are established to have emissivities or absorptivities above about 0.5 or 50%, and preferably close to about unity or 100% to obtain maximum heat transfer by radiation. Materials of construction include temperature resistant metals, metal oxides or ceramics. The heat exchange inserts are positioned to provide a surface area normal to the flow of fluid, but spaced apart sufficiently to provide high radiative heat transfer penetrating to the heat transfer surface from the inserts over a substantially unobstructed mean free path.

The apparatus and method of the present invention are designed to work at a maximum temperature of either the gas or chamber surface of at least 1,000° F. At a temperature below about 1,000° F., the heat exchanger of the present invention will not transfer heat at a rate high enough to be economically attractive.

The material of the heat exchange insert of the present invention is selected to provide a material having a high absorptance and emittance. Such materials are provided by metal oxides. For example, metals such as iron or steel, copper, or nickel, when oxidized form oxide coatings on the surface which are suitable for the heat exchange insert of our invention. These oxidized materials are wound about a core to form an insert substantially similar to a wire brush and inserted into a heat exchanger tube or conduit. It will be noted that these materials do not have to have a high thermal conductivity. For this reason, the appendages of the wire brush insert of the present invention are not required to contact the heat exchanger surface in which the insert is placed. In this regard, contact between the wires and the conduit walls does provide some conductive heat transfer but is a minor effect in the operation of the present invention.

Figure 2:
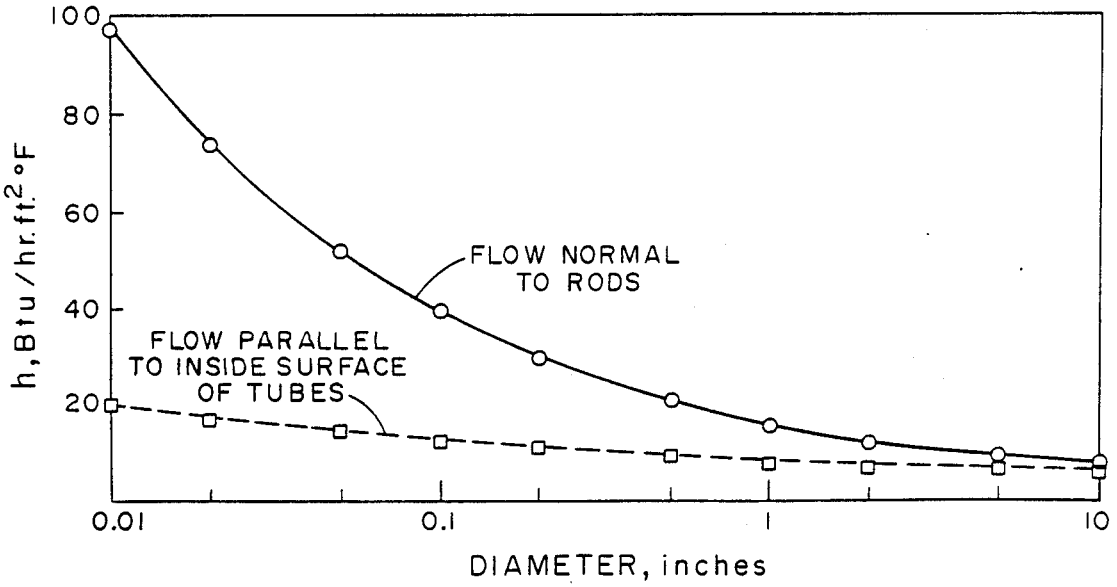
FIG. 2 shows a graphical comparision of heat transfer for gas flow parallel to wires compared to flow normal to wires.

Referring to FIG. 2, a graphical correlation is shown for comparing the calculated coefficients of heat transfer (h) for air at a velocity of about 30 ft/sec flowing normal to wires compared to flow parallel to the inside surface of a tube. Wires positioned normal to the flow of gas provide superior heat transfer coefficients, particularly at small diameters. Preferably, rod diameters are sized in the range of about 0.001 inch to 0.5 inch.

Figure 3:
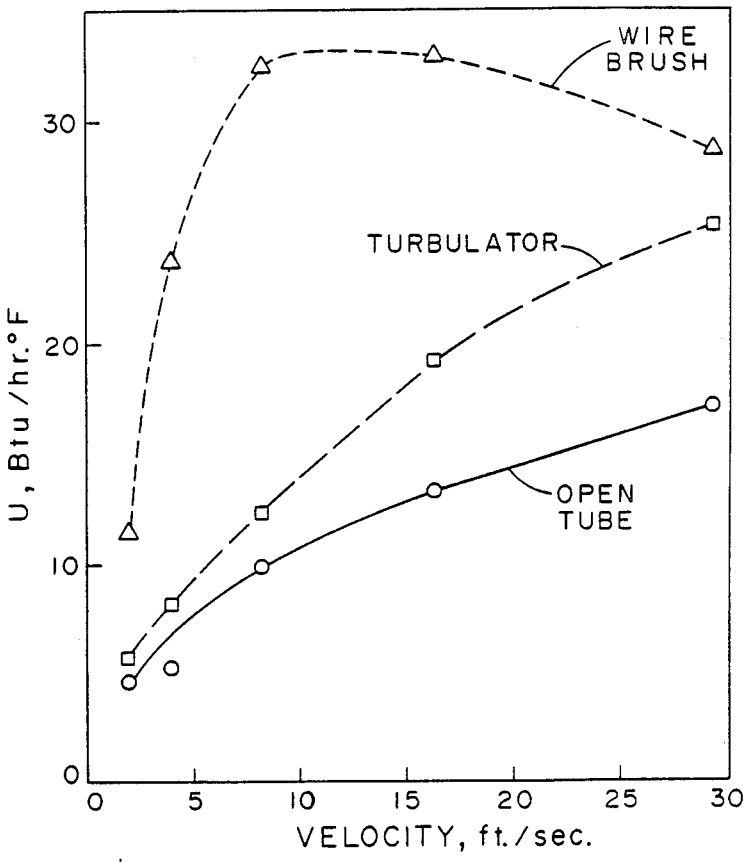
FIG. 3 depicts a graphical correlation of heat transfer coefficients between the heat exchange insert of the present invention and prior art inserts.

Referring now to FIG. 3, a graphical correlation is shown for comparing the heat transfer and Btu/ft$^2$-hr-° F. compared to variable air rates in ft/sec through a heat exchanger conduit. A tube packed with a wire brush consisting of 0.014 inch diameter 310 stainless steel wires with 92 wires per twist and 36 twists per foot provided superior heat transfer rates compared to an open tube or a tube containing a turbulator at air rates in the range of about 1 to 30 ft/sec.

While the invention has been described in terms of preferred embodiments, the claims appended hereto are intended to encompass all embodiments which fall within the spirit of the invention.

What is claimed is:

1. A method of increasing the heat transfer of a fluid passing along a surface at a temperature of at least about 1,000° F. comprising:

(a) establishing a wire brush of wire or fiber positioned substantially normal to the flow of said fluid along said surface, wherein said wire or fiber comprises a material having an absorptance and an emittance of at least about 0.5; and (b) providing a substantially unobstructed line of sight between said wire and said surface.

2. A method as set forth in claim 1 wherein said wire or fiber has a diameter in the range of about 0.001 inch to 0.2 inch.

3. A method as set forth in claim 2 wherein the maximum temperature of either the gas or chamber surface is at least about 1,000° F.

4. A method as set forth in claim 3 wherein said fluid is substantially clear.

5. A method as set forth in claim 4 wherein said fluid comprises a gas.

6. A method as set forth in claim 5, said wire or fiber having a surface comprising a temperature resistant, low thermally conductive metal oxide or ceramic fiber.

7. A method as set forth in claim 6 wherein said wire brush comprises at least about 24 appendages per linear inch.

8. A method as set forth in claim 7 wherein said surface has an absorptance and emittance above about 0.5.

9. A method as set forth in claim 8 wherein said fluid is passed at a flow rate in the range of about 1 to 30 ft/sec.

10. A method as set forth in claim 9 wherein said surface comprises the inner surface of a tube.

11. A method of heat transfer comprising:

(a) passing a substantially clear heat transfer fluid along a heat transfer surface at a temperature of at least about 1,000° F.;

(b) establishing a wire brush having a surface of temperature resistant, low thermally conductive wire of ceramic fiber or metal oxide in a position substantially normal to the path of said fluid, said wire having a radiative absorptance and emittance greater than about 0.5 and having a diameter in the range of about 0.001 inch to about 0.2 inch; and (c) providing a substantially unobstructed line of sight between said wire and said surface.

12. A method as set forth in claim 11 wherein the average temperature difference between said wire and said surface is at least about 1,000° F.

13. A method as set forth in claim 12 wherein said fluid comprises a gas.

14. A method as set forth in claim 13 wherein said fluid is passed at a flow rate in the range of about 1 to 30 ft/sec.

15. Heat transfer means comprising:

(a) a heat transfer surface;

(b) means for passing a heat transfer fluid along said surface at a temperature of at least about 1,000° F.; and (c) a wire brush positioned substantially normal to the direction of flow of said fluid along said surface and further positioned to provide a substantially unobstructed line of sight between said wire and said surface, said wire having a diameter in the range of about 0.001 inch to 0.5 inch and composed of a material having an absorptance and emittance of at least about 0.5.

16. Heat transfer means as set forth in claim 15, said wire having a surface comprising a temperature resistant, low thermally conductive metal oxide or ceramic fiber.

17. Heat transfer means as set forth in claim 16 wherein said heat transfer surface has an absorptance and emittance of at least about 0.5%.

18. Heat transfer means as set forth in claim 17 wherein said heat transfer surface comprises the inner surface of tube.

19. Heat transfer means as set forth in claim 18 wherein said wire comprises the bristles of a wire brush inserted into said tube.

20. Heat transfer means as set forth in claim 19 wherein said wire is composed of a material selected from the group consisting of metal oxides, carbides, borides, nitrides, silicides, carbon, and graphite.

* * * * *